US010174564B1

(12) United States Patent
Carter

(10) Patent No.: US 10,174,564 B1
(45) **Date of Patent: *Jan. 8, 2019**

(54) METHOD AND APPARATUS FOR CLEANING AN OIL AND GAS WELL RISER ASSEMBLY WITH MULTIPLE TOOLS SIMULTANEOUSLY

(71) Applicant: TRI-STATE ENVIRONMENTAL, LLC, Houma, LA (US)

(72) Inventor: Anthony Scott Carter, Petal, MS (US)

(73) Assignee: TRI-STATE ENVIRONMENTAL, LLC, Houma, LA (US)

( * ) Notice: Subject to any disclaimer, the term of this patent is extended or adjusted under 35 U.S.C. 154(b) by 132 days.

This patent is subject to a terminal disclaimer.

(21) Appl. No.: 15/292,930

(22) Filed: Oct. 13, 2016

Related U.S. Application Data

(63) Continuation of application No. 15/162,540, filed on May 23, 2016, now abandoned.

(Continued)

(51) Int. Cl.

| | |
|---|---|
| ***B08B 3/00*** | (2006.01) |
| ***B08B 7/00*** | (2006.01) |
| ***E21B 17/00*** | (2006.01) |
| ***E21B 17/01*** | (2006.01) |
| ***B08B 9/043*** | (2006.01) |
| ***B08B 5/04*** | (2006.01) |

(52) U.S. Cl.
CPC ..... *E21B 17/006* (2013.01); *B08B 5/04* (2013.01); *B08B 9/0433* (2013.01); *E21B 17/01* (2013.01)

(58) Field of Classification Search
CPC ..... B08B 9/04; B08B 9/0433; B08B 5/04; E21B 17/01; E21B 37/02; E21B 37/04; E21B 17/006
See application file for complete search history.

(56) References Cited

U.S. PATENT DOCUMENTS 1,704,364 A * 3/1929 Markley ..... B08B 9/0433 134/168 C
2,117,648 A * 5/1938 Bottorf ..... B24C 5/04 134/24

(Continued)

*Primary Examiner* — Alexander Markoff
(74) *Attorney, Agent, or Firm* — Garvey, Smith & Nehrbass, Patent Attorneys, L.L.C.; Charles C. Garvey, Jr.; Mackenzie Rodriquez

(57) ABSTRACT

The present invention relates to a method and apparatus for cleaning an oil and gas well riser section or assembly on location offshore that includes a larger diameter central pipe and a plurality of smaller diameter pipes that are spaced radially away from the central larger diameter pipe. Even more particularly, the present invention relates to an improved method and apparatus for cleaning oil and gas well riser sections wherein a specially configured cap or pair of caps are fitted to the ends of the riser which enable pressure washing cleaning tools (or a camera) to be inserted into and through a selected one of the pipes including either a smaller diameter of the pipes or the central larger diameter pipe and wherein the cap continuously collects spent cleaning fluid and debris, allowing the cleaning process to be done on location without transporting the riser section back onshore. In one embodiment, a specially configured back out preventer can be used to prevent inadvertent backwards travel of the cleaning tool during cleaning.

20 Claims, 12 Drawing Sheets

Related U.S. Application Data

(60) Provisional application No. 62/164,978, filed on May 21, 2015, provisional application No. 62/191,991, filed on Jul. 13, 2015, provisional application No. 62/329,341, filed on Apr. 29, 2016, provisional application No. 62/245,697, filed on Oct. 23, 2015.

(56) References Cited

U.S. PATENT DOCUMENTS 4,518,041 A 5/1985 Zublin
5,159,956 A * 11/1992 Kurihara ..... F28G 9/00 134/169 C
5,217,166 A * 6/1993 Schulze ..... B05B 3/0463 239/227
5,323,797 A * 6/1994 Rankin ..... B05B 1/14 134/167 C
5,964,414 A * 10/1999 Hardy ..... B05B 3/005 239/252
6,158,076 A * 12/2000 Rutkowski ..... E03F 9/005 15/104.31
6,684,706 B2 2/2004 Knight et al.
7,040,331 B2 * 5/2006 Garman ..... B08B 9/0433 134/167 C
7,231,968 B2 6/2007 Owens
8,118,091 B2 * 2/2012 Baker ..... B65D 59/02 138/89
8,381,816 B2 2/2013 Leduc et al.
9,844,803 B1 * 12/2017 Carter ..... B08B 9/04
2004/0050553 A1 * 3/2004 Edvardsen ..... E21B 37/00 166/367
2011/0052328 A1 * 3/2011 Frerich ..... E21B 17/01 405/224.2
2014/0060849 A1 * 3/2014 Pathak ..... E21B 33/037 166/344

* cited by examiner

METHOD AND APPARATUS FOR CLEANING AN OIL AND GAS WELL RISER ASSEMBLY WITH MULTIPLE TOOLS SIMULTANEOUSLY

CROSS-REFERENCE TO RELATED APPLICATIONS

This application claims the benefit of U.S. Provisional Patent Application No. 62/164,978, filed 21 May 2015; U.S. Provisional Patent Application No. 62/191,991, filed on 13 Jul. 2015; U.S. Provisional Patent Application No. 62/245,697, filed 23 Oct. 2015; and, US Provisional Patent Application No. 62/329,341, filed 29 Apr. 2016, all of which are incorporated herein by reference. Priority of U.S. Provisional Patent Application No. 62/164,978, filed 21 May 2015; U.S. Provisional Patent Application No. 62/191,991, filed on 13 Jul. 2015; U.S. Provisional Patent Application No. 62/245,697, filed 23 Oct. 2015; and, U.S. Provisional Patent Application No. 62/329,341, filed 29 Apr. 2016, is hereby claimed.

Incorporated herein by reference are U.S. Provisional Patent Application No. 62/068,441, filed 24 Oct. 2014; and, U.S. patent application Ser. No. 14/923,107, filed 26 Oct. 2015.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The present invention relates to the cleaning of oil and gas well riser sections or assemblies. More particularly, the present invention relates to a method and apparatus for cleaning an oil and gas well riser section or assembly on location offshore that includes a larger diameter central pipe and a plurality of smaller diameter pipes that are spaced radially away from the central larger diameter pipe. Even more particularly, the present invention relates to an improved method and apparatus for cleaning oil and gas well riser sections wherein a specially configured cap or pair of caps are fitted to the ends of the riser which enable pressure washing cleaning tools (or a camera) to be inserted into and through a selected one of the pipes including either a smaller diameter of the pipes or the central larger diameter pipe and wherein the cap continuously collects spent cleaning fluid and debris, allowing the cleaning process to be done on location without transporting the riser section back onshore.

2. General Background of the Invention

Oil and gas well riser sections typically include a central larger diameter pipe or tubular member that is surrounded by a plurality of three, four, or more, smaller diameter pipes held in spaced relation to the central pipe with plates or flanges. Flanges are provided at each end of the riser assembly or riser section. These flanges include openings that communicate with the bore or bores of the smaller diameter pipes. The flange has a central opening that communicates with the bore of the central larger diameter pipe.

In order to clean these pipe sections, it is necessary to remove rust, scale, debris, chemical deposits and the like from both the inner larger diameter pipe section bore as well as the smaller outer or peripherally placed pipe section bores. In order to avoid contamination, this cleaning process has been done onshore by removing and transporting the riser pipe sections from the offshore well, to an onshore cleaning site. Newer cleaning methods move the cleaning process offshore allowing the risers to be cleaned without removing them from the well. These methods require additional considerations to avoid having the removed rust, scale, debris, and chemical deposits be washed into the ocean. Additionally, there is a need to decrease the footprint of the machinery used in the cleaning process allowing it to be used offshore. There is also a need to speed up the cleaning process in order to make it more economical and efficient than removing the risers for cleaning.

BRIEF SUMMARY OF THE INVENTION

The present invention thus provides a method and apparatus for cleaning oil and gas well riser sections wherein the riser section includes a central larger diameter pipe or tubular member having a flow bore and a plurality of smaller diameter pipes or tubular members that are preferably connected to the central larger diameter tubular member with flanges or spacers. Each of the smaller diameter tubular members has a flow bore.

The method includes placing a first cap or fitting on one end portion of the riser section. The fitting preferably covers an end of the larger diameter tubular member as well as the ends of the smaller diameter tubular members. The fitting preferably has multiple openings including one or more centrally located openings and a plurality of circumferentially spaced apart outer openings that are each spaced radially away from the one or more centrally located openings. The fitting can include a cylindrically shaped portion and a circular portion that is preferably joined to cylindrically shaped portion. A flexible sealing member preferably helps join the cap or fitting to an end of the riser assembly.

In a preferred embodiment, a similar cap is also secured to the opposite side of the pipe to be cleaned, allowing for cleaning to take place in both directions simultaneously while also collecting the debris.

The method includes inserting a first cleaning tool through the centrally located opening and into the larger diameter tubular member. The cleaning tool includes a pressure washing tool that cleans the inside surface of the larger diameter tubular member. A cable preferably supplies fluid under pressure to the first cleaning tool.

The method preferably includes the inserting of a second cleaning tool through one or more of the outer or peripherally placed openings and into one of the smaller diameter tubular members. The smaller diameter tubular members are cleaned with a second pressure washing tool that preferably cleans the inside surface of the smaller diameter tubular member or members, one after the other. In preferred embodiments, additional smaller diameter cleaning tools may also be used in the other smaller diameter tubular members simultaneously.

The method preferably includes the suction of fluid from the cleaning operations via a fitting or discharge that is preferably placed at a lower end portion of the fitting so that gravity flow can remove such cleaning fluid on a continuous basis.

The outer openings are preferably positioned along a curved line that is radially spaced outwardly of the centrally located opening or openings, the curved line traversing each of the outer tubular members.

In one embodiment, each centrally located opening is generally aligned with the bore of the larger diameter tubular member.

In one embodiment, one or more outer opening are generally aligned with the bore of a smaller diameter tubular member.

In one embodiment, the riser section or assembly has one end portion with an annular flange, each tubular member connected to the flange and the fitting preferably attaches to the annular flange.

In one embodiment, the flange has an outer diameter and the fitting has a peripheral skirt with a seal having a diameter that is about equal to the flange outer diameter. Further, the method preferably includes attaching the fitting at the peripheral skirt to the annular flange.

In one embodiment, there are two caps or fittings, each preferably having a fitting being attached to each end portion of the riser section or assembly. In this embodiment, the cleaning tools may all be fed into the bores from the same end, or, alternatively, one or more cleaning tools can be fed into the pipe from one end, while one or more additional cleaning tools are fed into different bores from the opposite end allowing cleaning to take place in both directions simultaneously.

In one embodiment, a suction is applied to each of the caps or fittings to subject all flow bores of the riser section to a vacuum during cleaning operations. Preferably, the vacuum at least partially contributes to securing the caps or fittings to the riser section.

In one embodiment, there are at least three outer openings.

In one embodiment, there are between two and twenty outer openings.

In one embodiment, the outer openings are preferably arranged in a circle.

In one embodiment, some of the outer openings are aligned with a smaller diameter tubular member bore and some of the outer openings are not aligned with a smaller diameter tubular member bore.

BRIEF DESCRIPTION OF THE SEVERAL VIEWS OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION OF THE INVENTION

Figure 1:
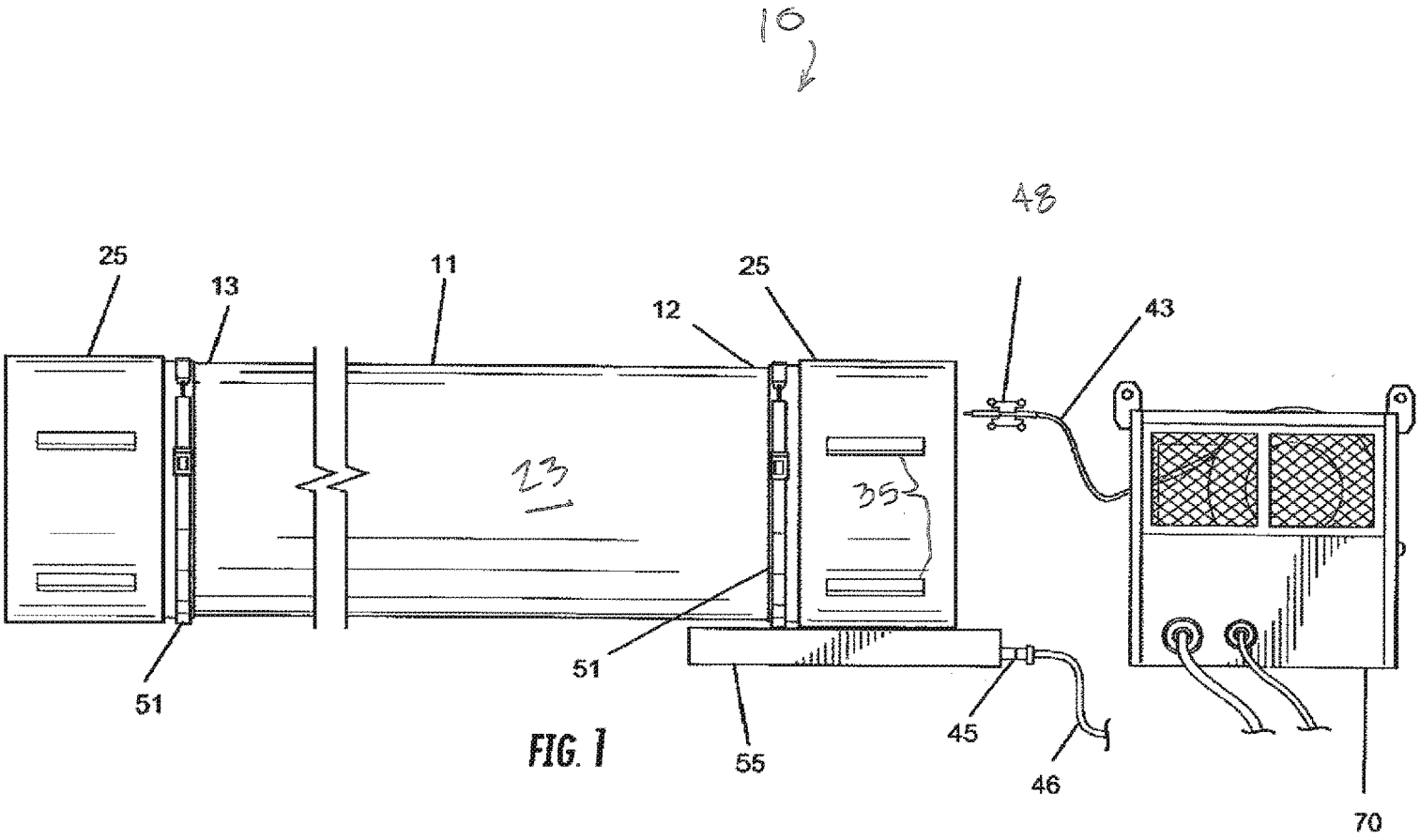
FIG. 1 is a schematic of a preferred embodiment of the method and apparatuses of the present invention with the cleaning tool out of the pipe.

In FIGS. 1-8, riser cleaning apparatus 10 is used to clean a riser assembly such as the riser assembly 11 shown in the drawings. Such a riser assembly 11 has a first end portion 12 and second end portion 13. Either or both of the end portions 12, 13 of the riser assembly 11 can be provided with an annular flange 14. The riser assembly 11 typically includes a larger diameter pipe or tubular member 15 surrounded by multiple smaller diameter pipes or tubular members 16.

Figure 6:
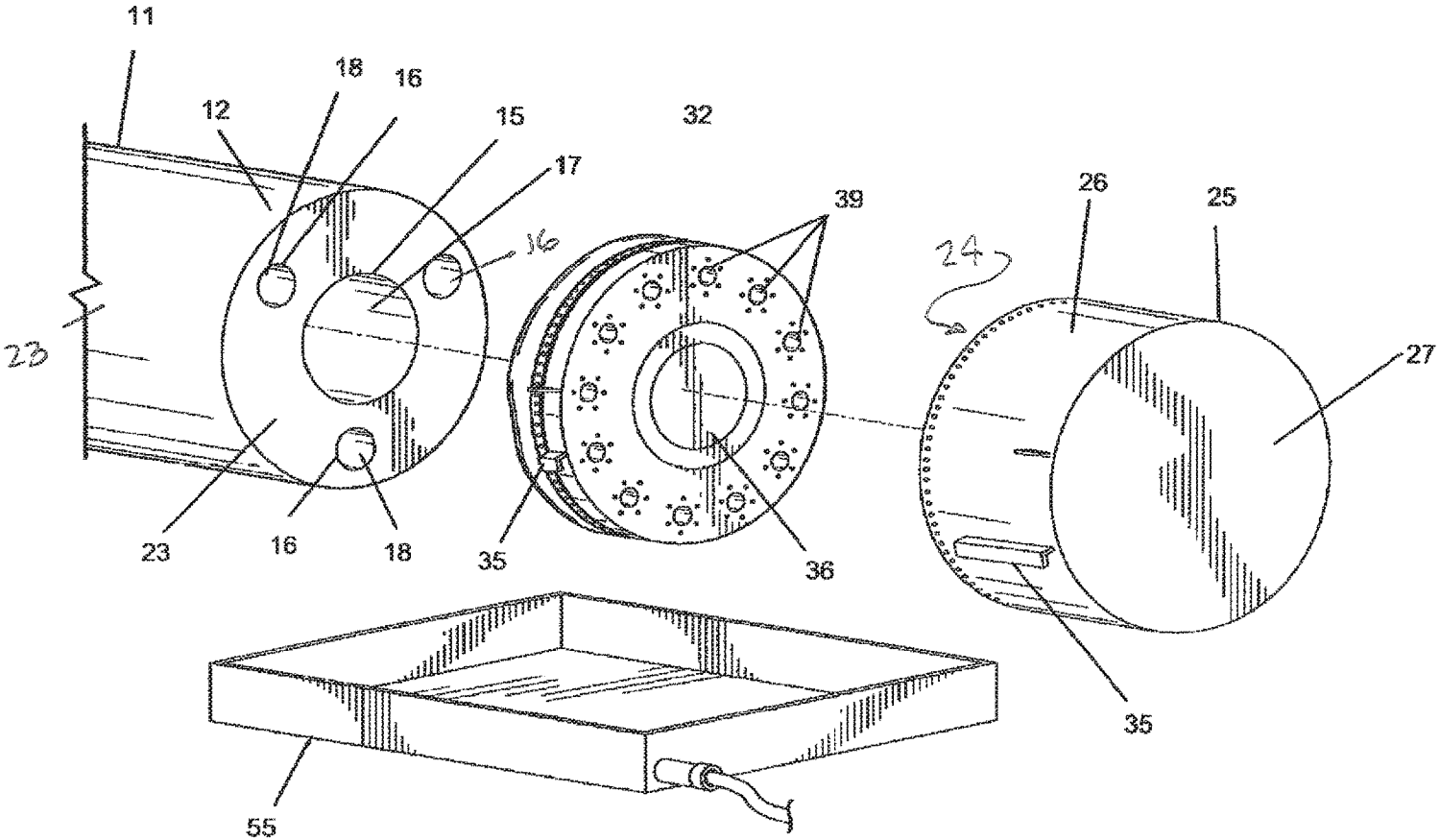
FIG. 6 is an exploded view of a preferred embodiment of the end cap, pipe, and drain pan of the present invention.
Figure 6A:
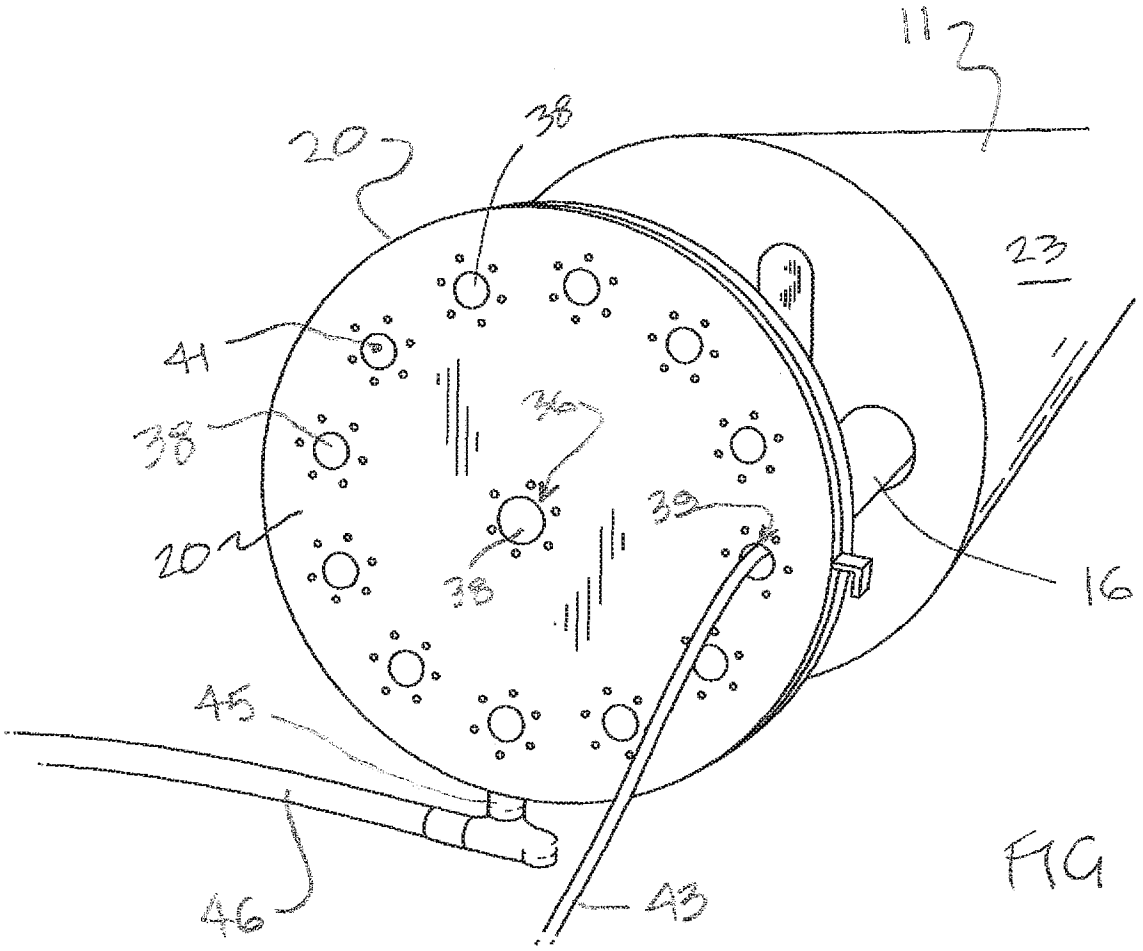
FIGS. 6A, 6B are fragmentary perspective views of the preferred embodiment of the apparatus of the present invention

The larger diameter pipe 15 has a pipe bore 17 of larger diameter. The smaller diameter pipes 16 each have a pipe bore 18 of smaller diameter. A flange 14, preferably an annular flange, can be a part of a riser assembly 11, as shown in FIG. 6. In the flange 14, there may be openings that do not align with a particular smaller diameter pipe 16. During cleaning, plugs 21 or 22 (not shown) may be used to block any such openings so that fluid is not leaked through the openings. The riser assembly 11 can include an insulation layer or protective covering or coating 23.

The cleaning tool apparatus 10 of the present invention and the method of the present invention preferably employ one or more caps, fittings or shrouds 25. These caps, fittings or shrouds can be placed on one end portion 12 of the riser assembly 11 or on both end portions 12, 13 of the riser assembly 11.

Each cap, fitting or shroud 25 preferably includes a cylindrical section 26, a circular wall 27, and a concave portion or cavity 24. Wall 27 can be welded to cylindrical section 26. The cylindrical section 26 has an inner surface 28 and an outer surface 29. The circular wall has an inner surface 30 and an outer surface 31.

A gasket or seal 32 can be attached to cylindrical section 26. The gasket or seal 32 can be attached to the cylindrical section 26 using band 33 and fasteners such as rivets 34. Straps 51 can be used to hold each cap, fitting or shroud to a selected end portion 12, 13 of a riser assembly 11. One or more handles 35 can be attached (for example, welded) to circular wall 27 of cap or shroud 25. In one embodiment (not shown), a rope such as a wire rope is removably attached to the outer surface 29 in a manner to axially support the lifting of the cap 25.

Figure 6B:
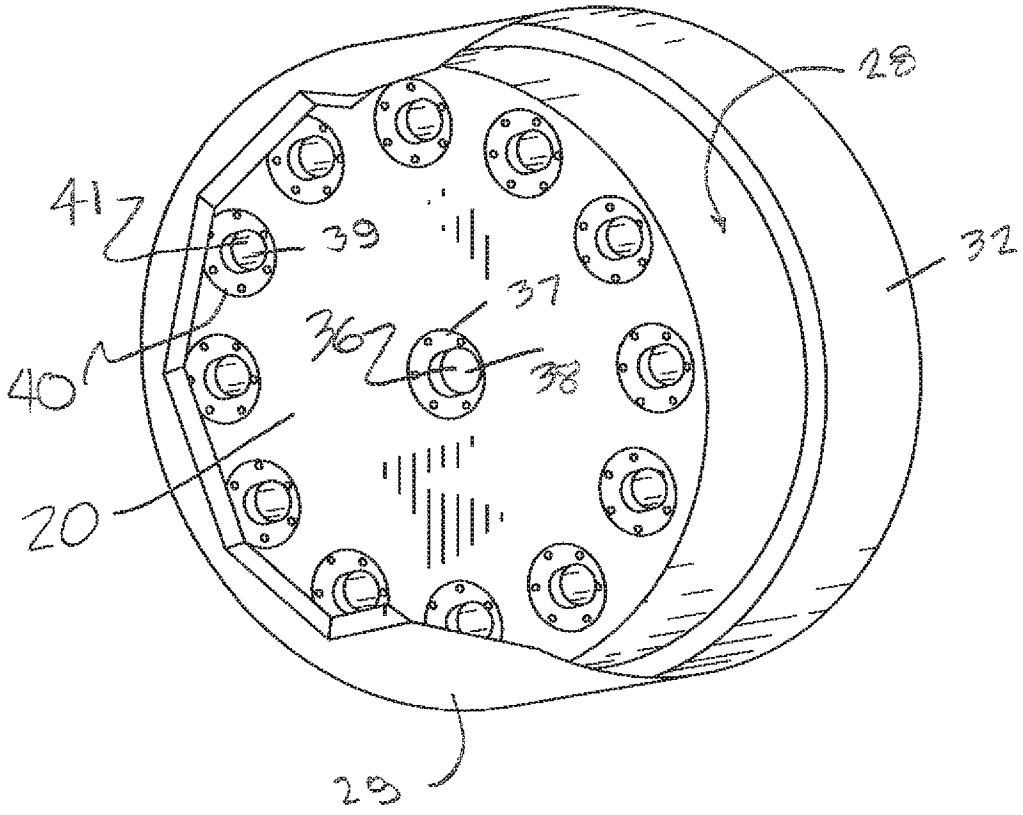

In one embodiment, the shroud 14 connects to a disk or circular member 20 that is provided with a plurality of openings 36, 39. These openings include central opening 36 and a plurality of peripheral openings 39. Each opening 36, 39 can be fitted with annular flange 37 or 40 and a seal or rubber sheet 38. In one embodiment, the flange 37 is preferably bolted to the flange disk 20 with fasteners, thus sandwiching the seal 38 in between the flange 37 and the disk 20. It should be understood that shroud 25 and disk 20 could be separable parts as shown in FIG. 6. Alternatively, the shroud 25 can include a circular end wall 27 having openings 36, 39 and flanges 37, 40 as well as seals/rubber sheets 38 and seal openings 41 as seen in FIG. 6B.

Each peripheral opening 39 is preferably fitted with an annular flange 40 and can include a seal 38 with an opening 41 that enables a hose 43 to pass through the seal 38 and its opening 41. The opening 41 in each seal 38 can thus be about the same inner diameter as the outer diameter of the hose 43.

Hose 43 supplies pressurized fluid to cleaning tool 48. Each seal 38 can have a small opening at 41 which allows insertion of the cleaning tool 10 and its pressurized hose 43 from the outer surface 31 of circular wall 27 to the inner surface 30 of circular wall 27, thus gaining access for the cleaning tool 48 and hose 43 to the bore 17 or 18 of a selected larger diameter pipe 15 or smaller diameter pipe 16 to be cleaned.

A hose feed device 44, such as AutoBox by StoneAge®, Model No. ABX-500, can be used to feed hose 43 into the selected bore 17 or 18 during cleaning, thus advancing the cleaning tool into and along a selected bore 17 or 18 until all of it is cleaned (i.e., inside surface of pipe 15 or 16).

Each cap or shroud 25 preferably has an outlet fitting 45 to which is attached a suction line 46. The suction line 46 would be coupled to a pump or like device that pulls the suction on the outlet fitting 45 and thus the interior of the riser assembly 11 in order to withdraw spent cleaning fluid. In one embodiment, caps or fittings or shrouds 25 are placed at both ends of the riser assembly 11, each of the caps or shrouds 25 having an outlet fitting 45 and a suction line 46. In this fashion, the suction lines 46 and their pumps assist in holding the caps or shrouds 25 to the riser assembly 11 by subjecting the entire interior of the riser assembly 11 to a vacuum. Hoses (not shown) can be attached to each flange 37, 40. Such hoses can be ell shaped and flexible Once cleaning is finished, a camera or like device can be used for inspecting the bores 17 or 18 (not shown). A camera line 49 can be provided as well as a camera feed device 50 for inserting the camera into a selected bore 17 or 18 (not shown).

Whereas Applicant, has cleaned risers by sending a high pressure cleaning tool down only one of the holes, in the riser, by way of a pneumatic feeder, in order for the offshore cleaning method to be economically superior to traditional onshore cleaning, the cleaning preferably occurs in a faster total time and cleaning equipment preferably takes up less total space on the well. To accomplish a faster cleaning time, the method of the present invention includes the option of cleaning all of the bores of a riser simultaneously. The largest bore 17 will preferably be cleaned by sending a high pressure cleaning tool 48, by way of a pneumatic feeder 44 on one end 12, 13. The three or four smaller bores 18 will preferably be cleaned in the same aforementioned fashion either on the same end, or on the opposite end of the riser 11 simultaneously.

To accomplish this faster cleaning while still taking up a smaller total space on the well, novel and improved cleaning tools 48 and assembly 10 have been developed. On one or both ends 12, 13 of the riser pipe 11, these cleaning tools 48 are being fed through the bores 17, 18 with high pressure water hoses preferably via pneumatic feeders 44.

A control panel can be provided to control, preferably pneumatically, multiple high pressure water hose feeders 44. A control panel may be adapted to control additional feeders 44, preferably four or six feeders 44.

Figure 8:
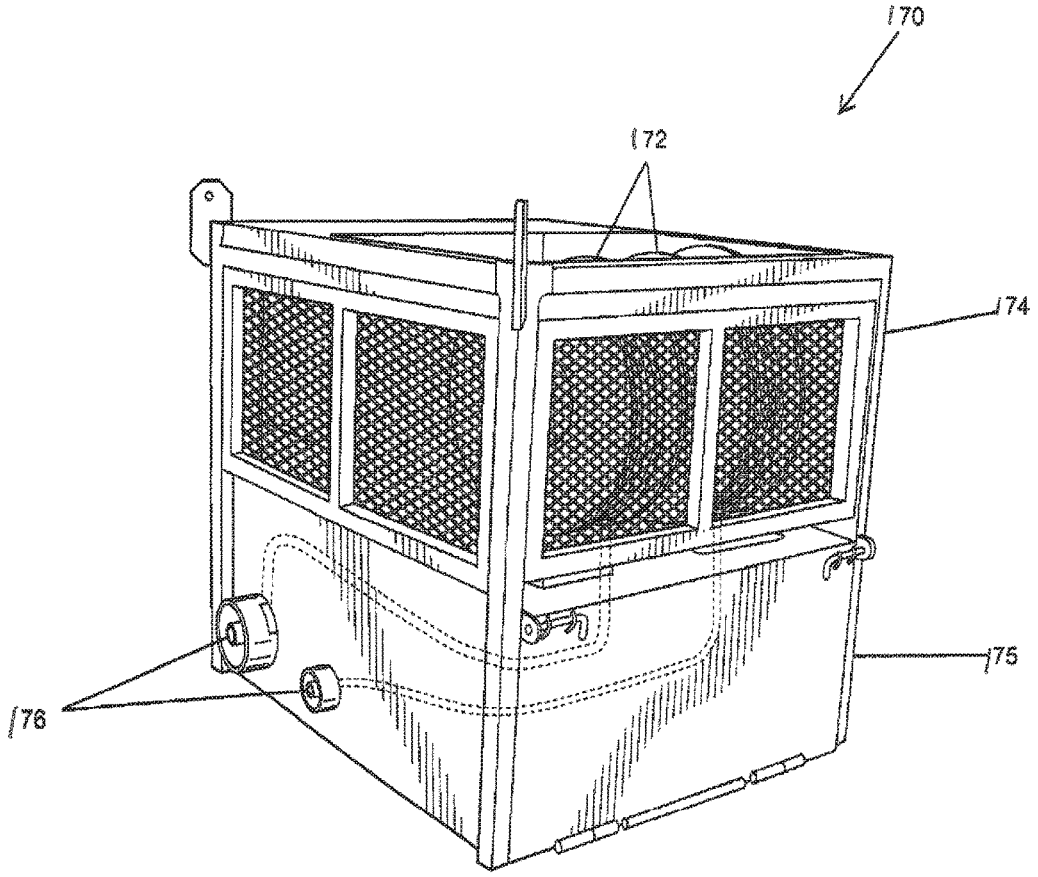
FIG. 8 is a perspective view of a preferred embodiment of the spool basket of the present invention.

To further decrease the total footprint spool or reel basket 170 as shown in FIG. 8 is provided. The spool basket 170 preferably has pad eyes for industrial transportation that hold the one or more pneumatic feeders 44 and one or more respective spools 172 of high pressure water hose 43. The spool basket 170 of the present invention as shown in FIG. 8 has an upper section 174 and lower section 175. The lower section is adapted with housings 176 for the high pressure water lines 43, power lines, and control lines for the pneumatic feeders 44. As shown, the lower section has housings 176 for two feeders 44; however, additional housing can be added to accommodate additional feeders 44. The upper section holds two pneumatic feeders 44 and two reels 172, the reels coordinate with each respective feeder 44. However, the basket 170 can be adapted to hold more feeders 44 and spools 172. Preferably, additional feeders 44 and spools 172 would be stored on top of the feeders 44 and spools 172 shown so that the total footprint of the equipment is not increased.

In a preferred embodiment, a control panel is preferably positioned to reduce the footprint. For example, a control panel may be positioned next to the spool basket 170.

In one embodiment, the output of water for four tools being run simultaneously is preferably 15 gallons per minute (gpm) for the larger bore holes 16, and 8 gallons per minute (gpm) for the choke, kill and boost lines.

In one embodiment, the output of water for four tools being run simultaneously is preferably 39 gallons per minute (gpm).

In one embodiment, the total time to clean is approximately 15 minutes.

The control panel and spool basket 170 enable controlling of multiple high pressure water cleaning tools 48, simultaneously with minimal man power and minimal human exposure to moving parts.

In a preferred method, there can be two control panels and two spool baskets 170, with a spool basket 170 at each end 12, 13 of a riser 11, and the two control panels can be side by side on one end 12, 13 or remote from one another. Preferably, there is a separate human operator for each control panel, though if they are side by side one human operator is preferably able to operate both.

In another preferred embodiment, the control panel can be adapted to control four or six feeders 44, all of which are housed in one spool basket 170 as described above, at one end of the riser pipe 11.

The cleaning method of the present invention preferably makes use of an improved pressure washing tool 48 that cleans the inside surface of the larger diameter tubular member 17 and other improved pressure washing tools 48 that clean the inside surface of the smaller diameter tubular members 18 simultaneously. A cable or hose 43 preferably supplies fluid under pressure to the cleaning tools 48.

Figure 7:
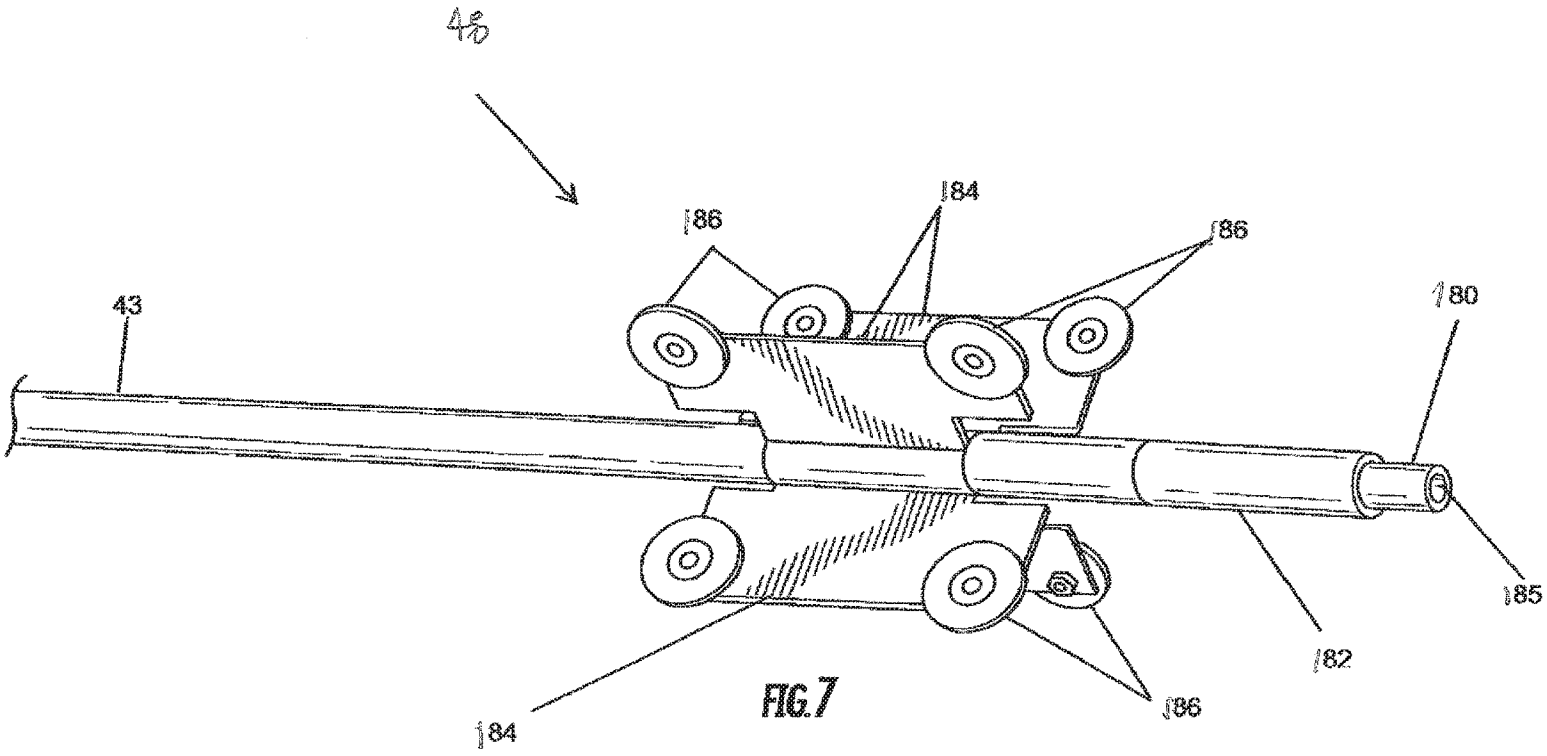
FIG. 7 is a perspective view of a preferred embodiment of the cleaning tool of the present invention.

In a preferred embodiment shown in FIG. 7, the pressure washing tool 48 of the cleaning method includes a head 180 connected to a tubular body 182, and a support structure surrounding the tubular body 182. The head 180 preferably includes at least one orifice 185. The orifice(s) 185 of the head 180 preferably allow pressurized water to pass through during cleaning. In one embodiment (not shown), the head 180 also includes more than one opening along the same axis that preferably allows for a stabilizer bar to pass through the openings. In a preferred embodiment, the support structure is extensions 184 that extend radially from the tubular body 182 of the tool 48. Preferably there are at least three extensions 184. More preferably there are four extensions 184. Most preferred, the extensions 184 have one or more wheels 186, preferably two wheels 186 on each of four extensions 184, as shown in FIG. 7. This design is preferable because the extensions stabilize the tool 48 in the center of the line, and the wheels 186 alleviate drag providing for a faster cleaning time. Additionally, wear and tear on the tool 48 is decreased, which lengthens the life of the tool 48. In another embodiment, additional wheels 186 may be added to the nose 180 of the tool 48, to alleviate dipping of the nose during cleaning. In another embodiment (not shown), the support structure is comprised of three or more leg-like extensions, the leg-like extensions having a proximal portion and distal portion, wherein the proximal portion extends radially out from the tool 48, at an angle between 30 and 90 degrees from the tubular body 182, and wherein the distal portion is parallel to the inner wall of the bore 17, 18 to be cleaned. In this embodiment, the distal portion of the leg-like extension is equipped with one or more, preferably two, wheels that are adapted to roll along the inner wall of the bore 17, 18 to be cleaned. This embodiment may further include one or more wheels on the nose of the tool 48.

Prior versions of a cleaning tool for riser pipes did not have wheels 186 or extensions 184, which caused stripping of the tool. In those prior versions that did have extensions for support, the extensions were too short and allowed the nose of the tool to dip. Additionally, no wheels were provided which created significant drag in the riser that required more time and power to overcome.

In one embodiment of the present invention, an improved method of cleaning riser pipes is provided All PPE (personal protective equipment) to be worn is as follows; Hardhat, Steel-toed Boots, Safety Glasses, Flame Resistant Clothing (FRC) [Either coveralls of separate shirt/pants combinations], and Orange Reflective Vests. Equipment Operators will wear specialized PPE for optimal safety protection. One or more operators or crewmembers will survey conditions and check for hazards to ensure a safe operation. Operators or crewmembers will place equipment in a manner that avoids trip hazards and other safety hazards.

A crewmember will begin running lines 43, 46. The crewmember will connect a water line 43 from the pump (not shown) to a water line housing 176 on the Spool Basket 170. The housing connects to a "Y" connection that routes the high pressure water to each spool 172. Each spool 172 then connects to the feeder 44. One crewmember will set up diaphragm pumps, preferably two pumps, one for each end 12, 13 of the risers 11. Preferably, the diaphragm pumps are 2-inch pumps. The crewmember will then connect a discharge hose to the pump, preferably two hoses, also for each end 12, 13 of the risers 11. Preferably, the discharge hoses are 2-inch discharge hoses. The discharge hoses connect to the riser shroud 25, preferably by way of a 2-inch female camlock located at the bottom of the cap.

Crewmembers will set up and place the discharge containment system catch pan 55 so that no discharge spills on the rig floor. A crewmember will measure the depth of the rubber seals on both ends of each riser 11. Two markers will be placed on the lance-line signifying the corresponding depth of the rubber seals so as not to damage the rubber seals with, up to, 10,000 psi of water pressure.

Figure 2:
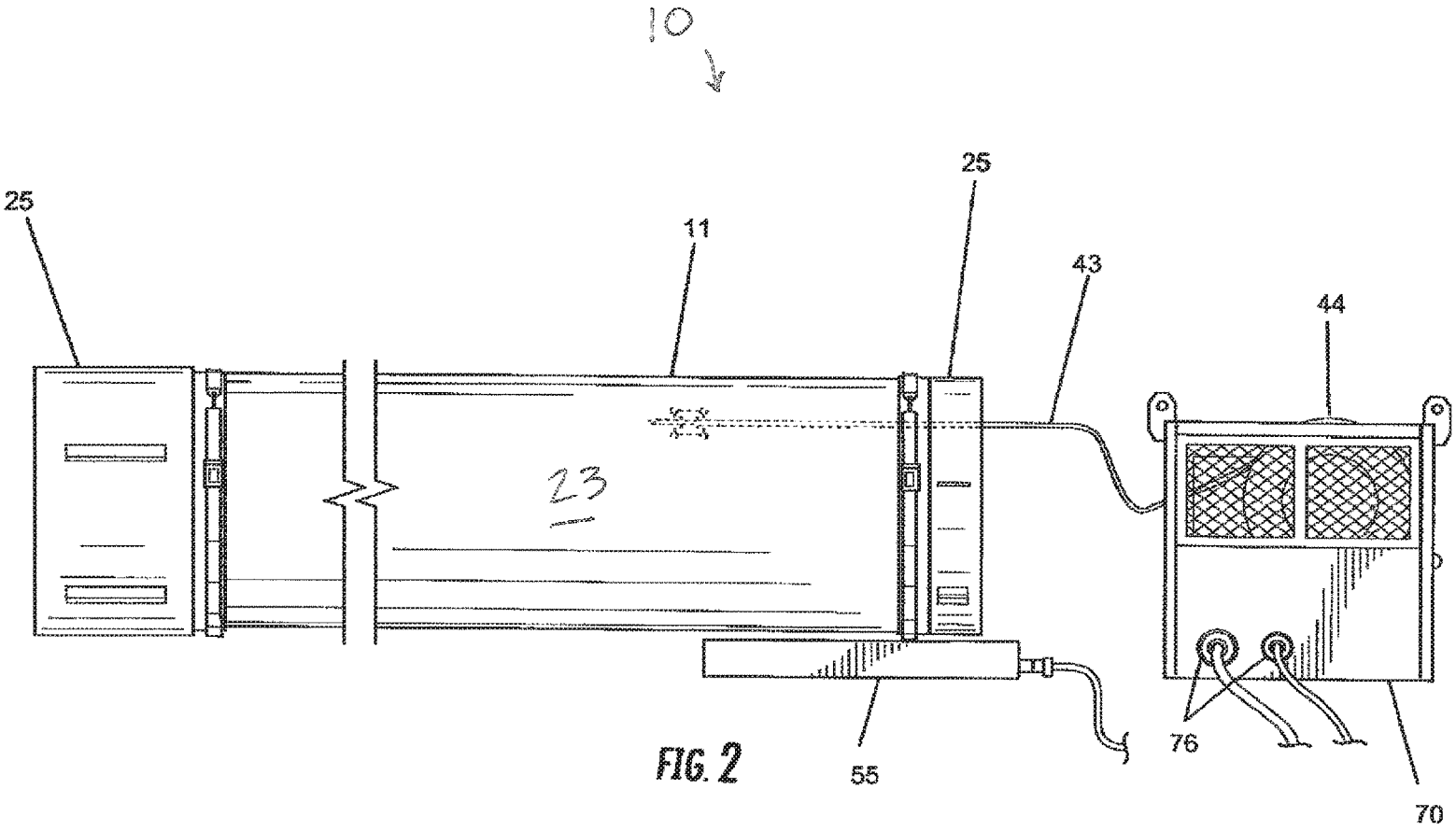
FIG. 2 is a schematic of a preferred embodiment of the method and apparatuses of the present invention with the cleaning tool in the pipe.
Figure 3:
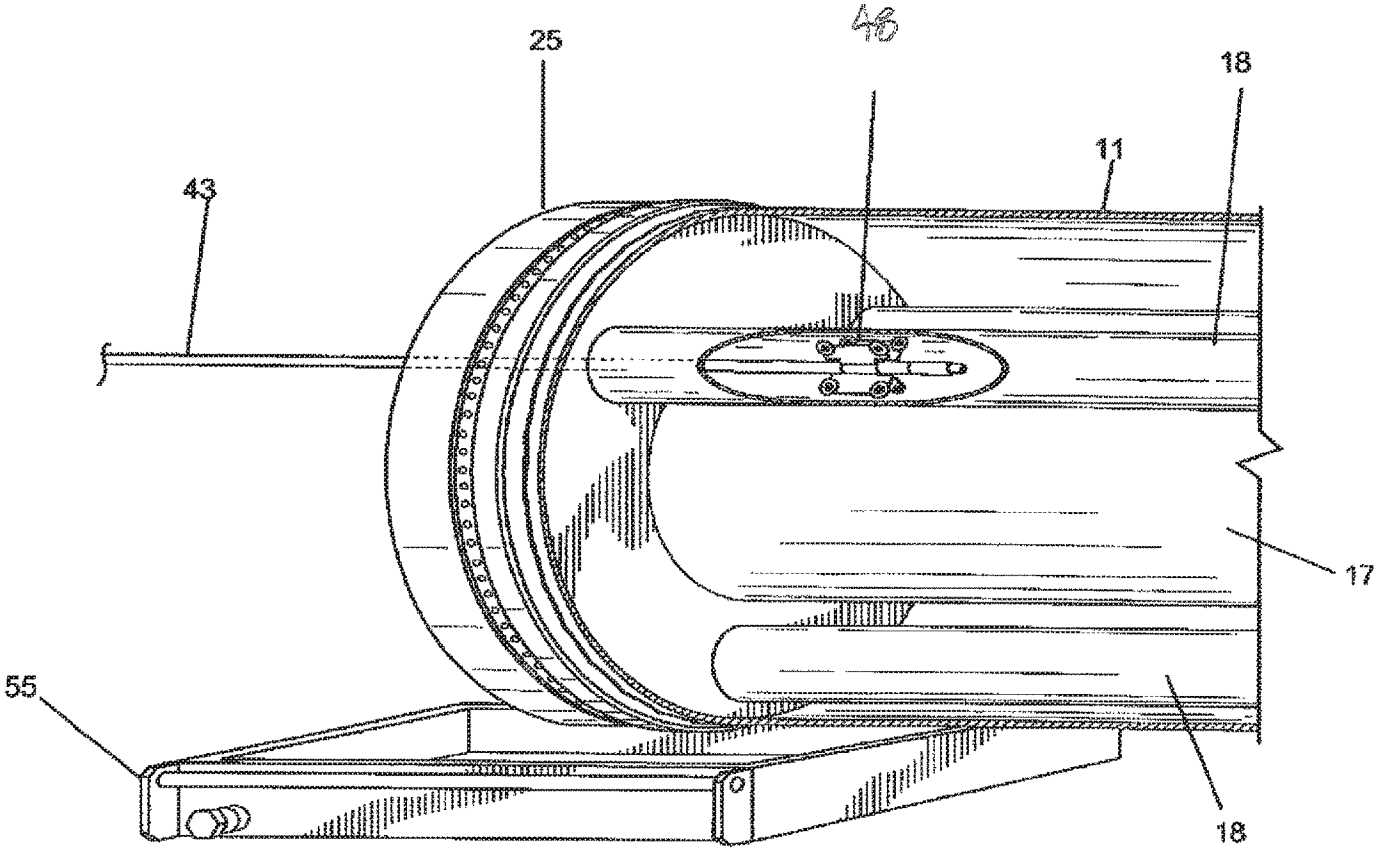
FIG. 3 is a close up side view of a preferred embodiment of the apparatus of the present invention with a cut-away showing the cleaning tool.
Figure 4:
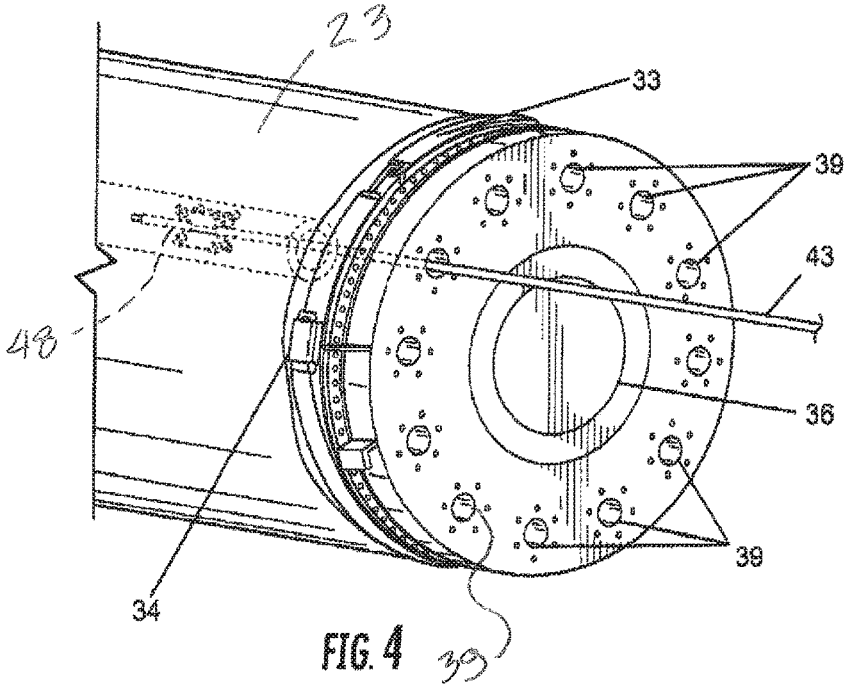
FIG. 4 is a close up front view of a preferred embodiment of an end cap of the present invention in place on a pipe with a cut-away showing the cleaning tool.
Figure 5:
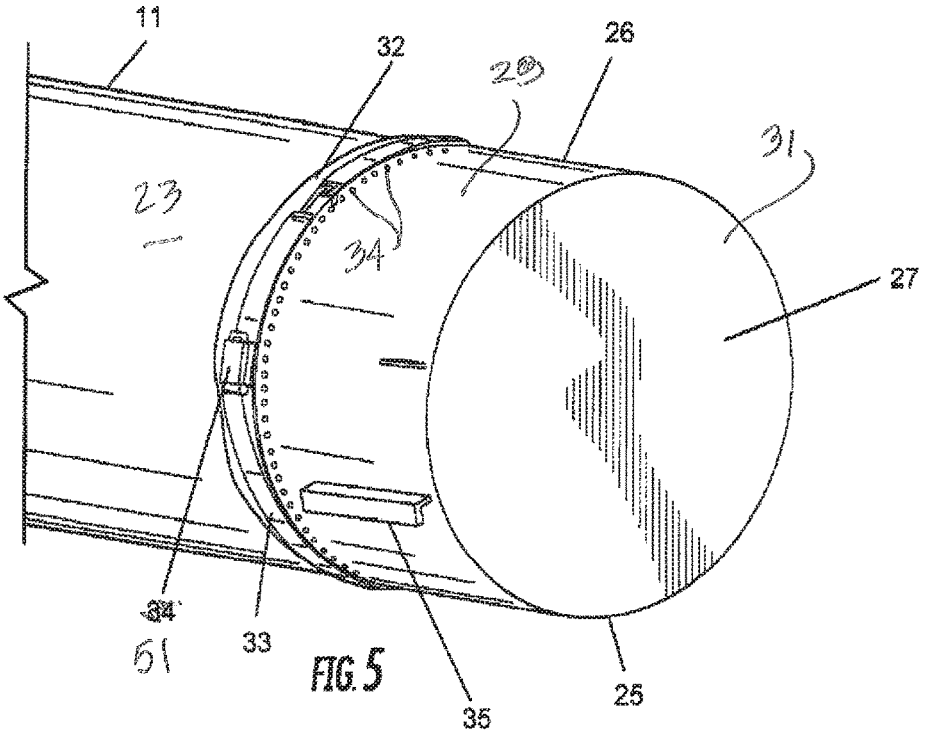
FIG. 5 is a close up front view of a preferred embodiment of an end cap of the present invention in place on a pipe.

The lance-lines 43 that coordinate with the one or more cleaning tools 48 will be threaded through the outside of the cap or shroud 25 inward, as shown in FIGS. 2-4. The lance-lines 43 will then be connected to the cleaning tools 48. The crewmembers will then close the shroud 25 over the outer diameter of the riser flange 14 and secure it, for example, with a band clamp 33 as shown in FIGS. 4-5. (Installation of caps or shrouds 25 on both ends is preferably identical.) On one end, crewmembers will rig up the cap 25, a preferably 2-inch suction hose 46, and the large and small cleaning tools 48 will be placed in their respective holes 15, 16. The pump will have a rig-water line connected to it.

Shrouds or caps 25 are to be installed on both ends 12, 13. On each end of the riser 11 where they will secure the shroud or cap 25 around the outer diameter of the riser flange 14 with a band clamp/ratchet strap 51/33. The suction hose 46 will be connected to the 2-inch female camlock 45 that is attached to the shroud or cap 25. Any bolt-holes will be plugged up. The 2-inch suction hose 46 will be connected to a 2-inch diaphragm pump. Once all components have all connections secured, and all shrouds 25 are installed, one or more lance-lines 43 with their respective tools 48 will be cleaning from one or both ends 12, 13.

A control panel can be used to actuate the feeders 44. With the water pressure high, the feeders 44 will begin moving the tools 48 down the length of the riser 11. Once to the end of the riser 11, the feeder 44 will be set in reverse and begin pulling the tools/lance-lines 48/43 back. This action will re-spool the lance-lines 43 onto the spools 72 in the spool basket 70.

There are large tools 148 for large pipes 15 and small tools 148 for small pipes 16. The orifice(s) 85 in the tool 148 are preferably pointed to grab directionally forward for a faster initial trip.

Traditionally, a small cleaning tool, called a Banshee, was used to clean small holes in risers because it was small enough to fit in the auxiliary lines. The Banshee was small enough to be stung into the rubber seals of the caps; however the life of the Banshee's rotating mechanism was insufficient, and when rotating ceased, the tool would stripe interior surface area of auxiliary lines and the tool would bounce around on the inside of auxiliary lines. To improve on this, a slightly larger version of the Banshee called the Badger was developed. The Badger had a better rotating mechanism, so it was more dependable with no striping. Still, the Badger would eventually bounce around the inside of the lines, shortening the life of the tool. The cleaning tool 48 of the present invention provides centralizers or extensions 184, preferably with wheels 186, on the rear end of the tool 48. These improvements stabilize the tool 48 in the center of the bore 18, and alleviate drag providing for a faster cleaning time. Additionally, they lengthen the life of the tool 48.

Centralizing fins have been added to the tool 48, and wheels were added to the nose. The fins centralize the tool in action, so there is less bouncing, and the wheels on the nose help to alleviate the dipping. But, neither the fins nor the wheels completely prevent the tool's nose from dipping, which causes the tool to stripe.

Centralizers 184 with a longer and larger frame with wheels 186 have been added to the cleaning tool 48 to overcome problems of the prior tools used. The wheels 186 alleviate drag. Additionally, the tool 148 is preferably machined with larger orifices 185, and with at least four 15° fan tips to help eliminate striping and provide for uniformed cleaning.

A control panel allows for control of multiple feeders 44 and reels 172. The control panel consolidates the pneumatic hoses that connect to the feeder 44. This control panel has the capabilities of controlling more than one feeder 44 simultaneously. In a preferred embodiment, shown in the figures, two feeders 44 are controlled simultaneously. In another embodiment, four feeders 44 are controlled simultaneously from the control panel. Additional feeders 44 may also be added. The control panel can incorporate a foot pedal into the panel board and is controllable by a toggle switch, further reducing the footprint of the equipment needed for the method.

The feeder 44 used in the method of the present invention is preferably controlled pneumatically. The feeder 44 clamps down on the high-pressure water lines (lance lines) 43. When actuated forward or backward, the lance line 43 will move forward and backward. This motion allows us to control the tripping of the lance line 43 and corresponding cleaning tool 48 down the length of the riser assembly 11. The pneumatic feeder 44 allows the operator to trip the lance line 43 forward and backward in the riser 11. In a preferred embodiment, a spool basket 170 is a portable enclosed tool box with two or more feeders 44, two or more spools 172 with lance lines 43 corresponding to the feeders 44, and connections 176 for pneumatic hoses and high pressure water lines to connect to their respective tools. This basket 170 is comprised of two or more feeders 44, two or more lance line spools 172, and connections 176 for pneumatic and water hoses lessening the footprint, and eliminating a number of tripping hazards. The spool basket 170 preferably has wheels (not shown), making it portable. The feeders 44 are positioned for ease of lance line 43 access to entry ports 36, 39 on the cap(s) or shrouds 25.

Caps or shrouds 25 are used on the ends of the riser 11 to contain discharge while maintaining the ability to stab the lance line 43 through a small hole 36, 39 in the cap 25. The cap 25 is preferably reinforced with aluminum, and rubber tubes are preferably placed on the interior of the stabbing holes to eliminate back pressured discharge. Multiple stabbing holes 36, 39 allow for multiple tools 48 and lines 43 to work in the cap 25 simultaneously. Finally, the addition of a discharge line 46, repositioned at a 90° angle allows for discharge back pressured waste.

A second shroud or cap 25 allows for capture of discharge, discharge pump-off, and cleaning from the opposite side of the riser 11. Preferably, a cavity is added for the large bore 17 so that a cleaning tool 48 can fit in and properly flush out the discharge.

Figure 9:
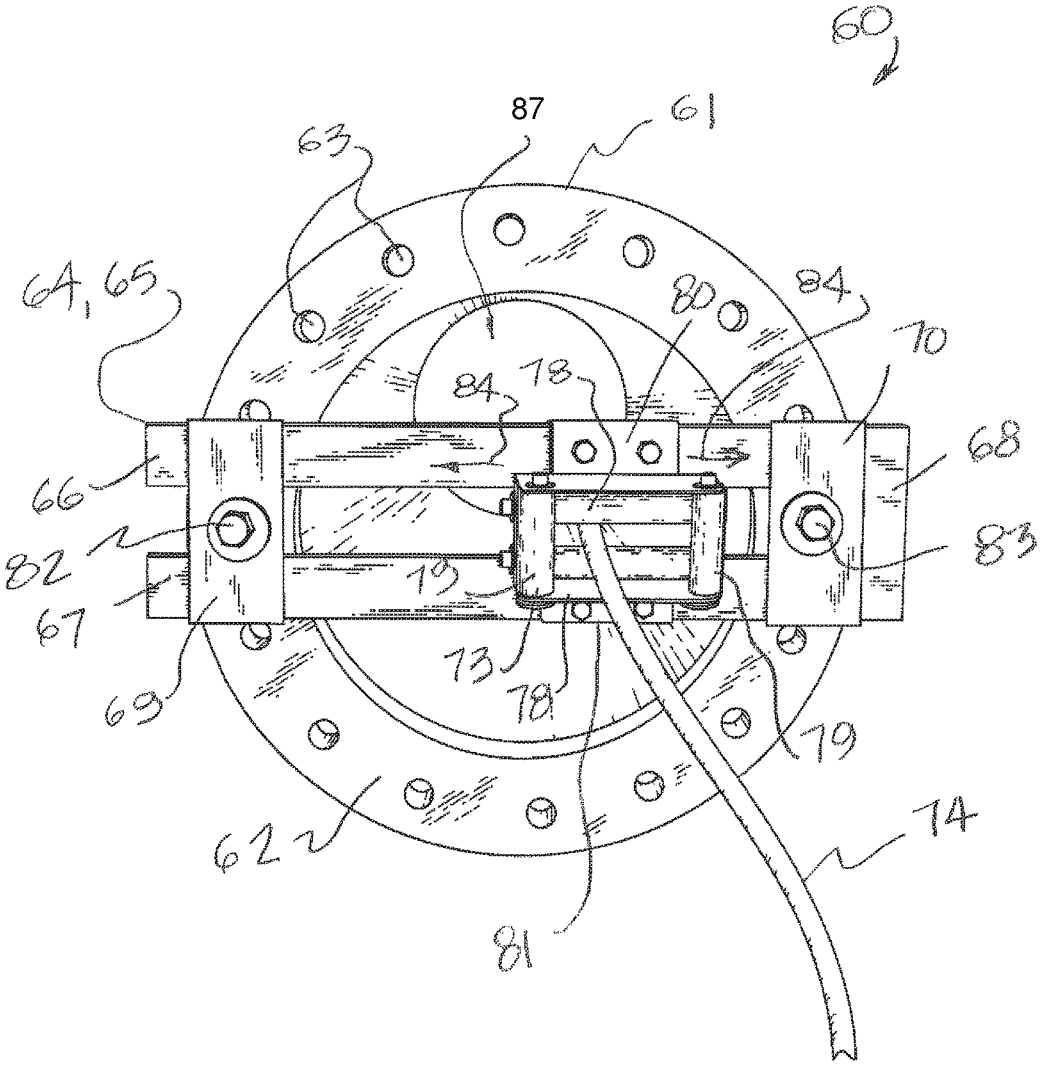
FIG. 9 is a partial perspective view of a preferred embodiment of the apparatus of the present invention and illustrating part of the method of the present invention.
Figure 10:
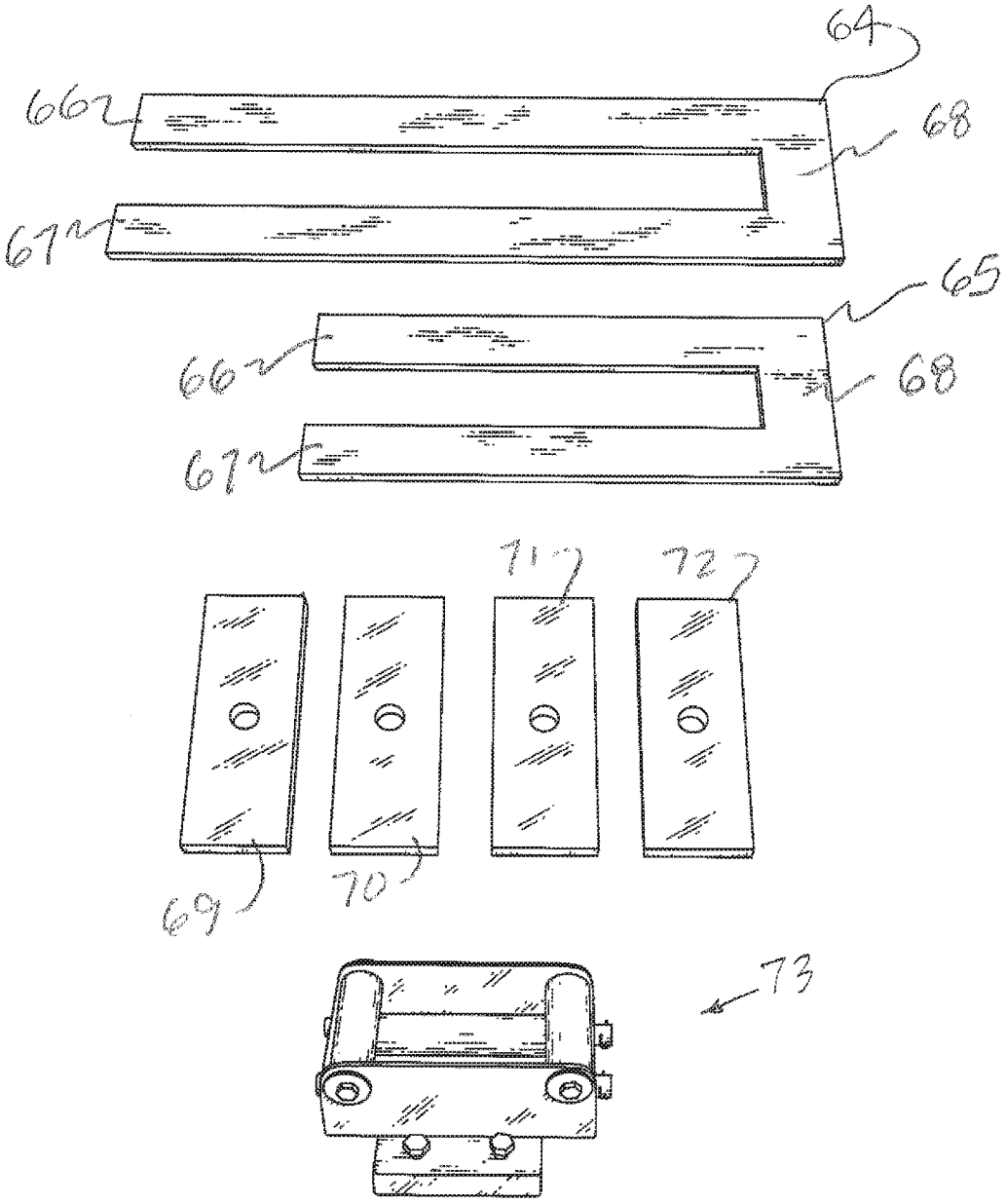
FIG. 10 is an exploded view illustrating components of the back out preventer of FIG. 10.
Figure 11:
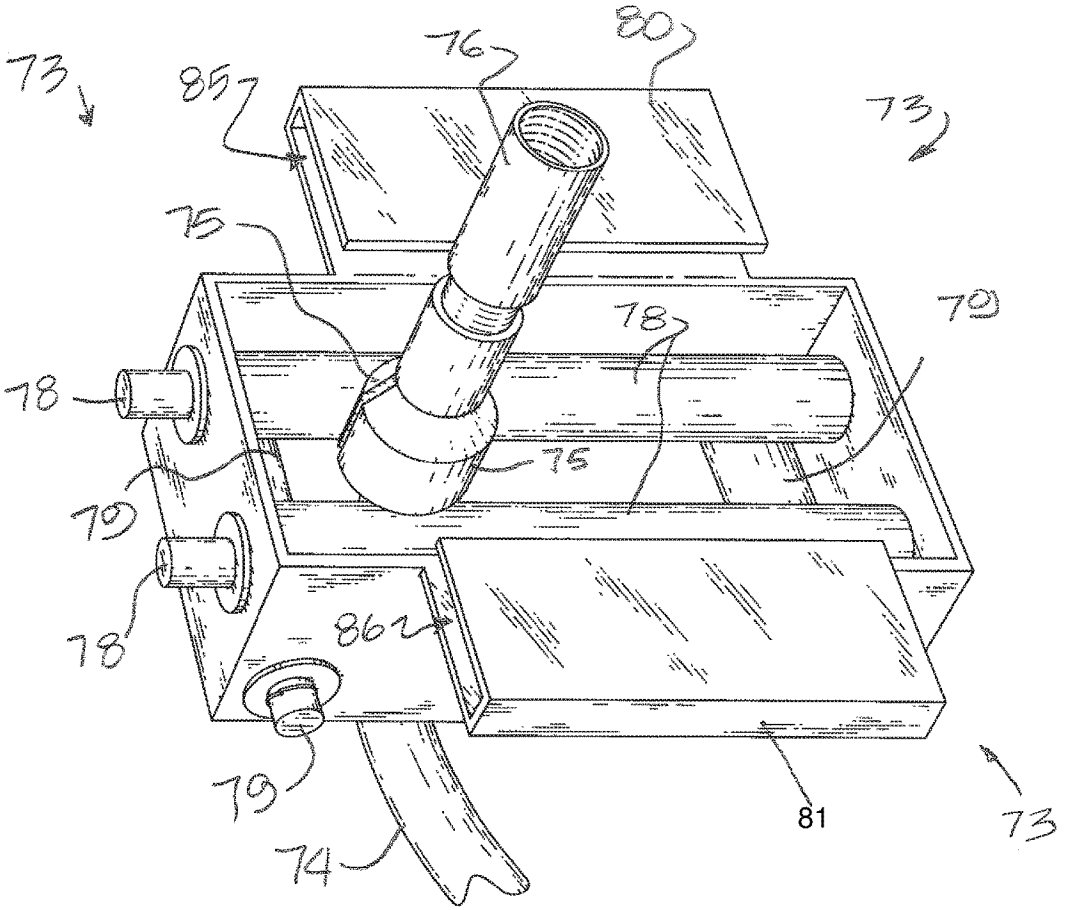
FIG. 11 is an exploded view illustrating components of the back out preventer of FIG. 10.

A back up preventer or hose and pressure washing tool retainer 60 can be seen in FIGS. 9-11. The preventer or retainer 60 attaches to riser 11 having an attached annular flange or to a pipe 61 or other adapter having an annular flange 62. Flange 62 can be a weld neck type annular flange having a plurality of bolt circle openings 63, each receptive of a bolted connection (not shown) that enables the pipe or riser 61 and flange 62 to be connected to another pipe/riser and flange 62 or other pipe spool or other equipment. The apparatus 60 can be used in concert with the cleaning of a riser 11, connected to an annular flange 62 that is part of or connected to the riser 11.

In FIG. 9, bolted connections at 82, 83 hold a selected plate 69 or 70 to annular flange 62 wherein each bolted connection 82, 83 includes a bolt that extends through a bolt circle opening 63 and connects with a nut. A washer can also be a part of bolted connection 82 or 83.

Bolted connections 82, 83 and fastener plates 69, 70, 71, 72 hold and support a mounting plate 64 or 65, each having longer flanges or plates 66, 67 connected with a shorter flange or plate 68.

Roller assembly 73 is mounted to a selected mount or plate 64 or 65 so that it can travel laterally as indicated by arrows 84 in FIG. 9. Roller assembly 73 includes roller frame 77 having upper and lower guides 80, 81. Each guide has a slot 85, 86 that is receptive of a larger flange or plate 66 or 67. Upper guide 80 has slot 85 that receives flange 66. Lower guide 81 has a slot 86 that receives flange 67.

Roller frame 77 has a pair of horizontal rollers 78 and a pair of vertical rollers 79. High pressure hose or lance line 74 is connected to a cleaning tool 31 that emits a high velocity, high pressure fluid stream (or streams) for cleaning the inside of pipe 61 or riser 11. Enlarged nut/enlarged annular fitting 75 (also known as "hose stop") is a "stop" attached to hose 74 next to coupling 76. Coupling 76 enables attachment to the cleaning tool (e.g., 48) that receives pressurized fluid from hose 74 and a high pressure pump. The nut or fitting 75 is too large to fit through the opening that is between a pair of horizontal rollers 78 or between a pair of vertical rollers 79 thus preventing escape of the cleaning tool 48, coupling 76 and hose 74 from the bore 87 of pipe 61.

The following is a list of parts and materials suitable for use in the present invention:

PARTS LIST

Part Number Description
10 riser cleaning apparatus
11 riser assembly
12 first end portion
13 second end portion
14 annular flange
15 larger diameter pipe
16 smaller diameter pipe
17 pipe bore (larger diameter)
18 pipe bore (smaller diameter)
20 disk/circular member
23 insulation/protective covering
24 concave portion/cavity
25 cap/shroud/fitting
26 cylindrical section
27 circular wall
28 inner surface
29 outer surface
30 inner surface
31 outer surface
32 gasket/seal
33 band
34 fastener/rivet
35 handle
36 central opening
37 flange
38 seal/rubber sheet
39 peripheral opening
40 flange
41 seal opening
43 hose
44 hose feed device
45 outlet fitting
46 suction line
47 hose
48 cleaning tool
49 camera line
50 camera feed device
51 strap
55 catch pan
60 back out preventer/hose and pressure washing tool retainer
61 pipe/riser
62 annular flange
63 bolt circle opening
64 mount/plate

65 mount/plate
66 longer flange/plate
67 longer flange/plate
68 shorter flange/plate
69 fastener plate
70 fastener plate
71 fastener plate
72 fastener plate
73 roller assembly
74 high pressure lance line/high pressure hose
75 enlarged nut/fitting/annular stop member ("hose stop")
76 coupling
77 roller frame
78 horizontal roller
79 vertical roller
80 upper guide
81 lower guide
82 bolted connection
83 bolted connection
84 arrows
85 slot
86 slot
87 bore
170 spool basket
172 reels or spools
174 upper section of spool basket
175 lower section of spool basket
176 housings
180 nozzle of cleaning tool
182 tubular member of cleaning tool
184 extensions
185 orifice(s) of cleaning tool
186 wheels All measurements disclosed herein are at standard temperature and pressure, at sea level on Earth, unless indicated otherwise. All materials used or intended to be used in a human being are biocompatible, unless indicated otherwise.

The foregoing embodiments are presented by way of example only; the scope of the present invention is to be limited only by the following claims.

The invention claimed is:

1. A method of cleaning an oil and gas well riser section that has a central larger diameter tubular member having a flow bore and a plurality of smaller diameter tubular members connected to the central larger diameter tubular member, each smaller diameter tubular member having a flow bore, the method comprising the steps of:

a) placing a fitting on an end portion of the oil and gas well riser section, the fitting covering an end of the larger diameter tubular member and the ends of the smaller diameter tubular members, wherein the fitting has multiple openings including one or more centrally located openings and a plurality of circumferentially spaced apart outer openings that are aligned with a bore of a smaller diameter tubular member and that are spaced radially away from each of the one or more centrally located openings, said fitting having a drain opening;

b) inserting a first cleaning tool through the centrally located opening and into the larger diameter tubular member, wherein said first cleaning tool cleans the inside surface of the larger diameter tubular member;

c) inserting one or more second cleaning tools through one or more of the outer openings and into one or more of the smaller diameter tubular members, wherein said second cleaning tool cleans the inside surface of the smaller diameter tubular member; and d) removing fluid from the cleaning operations of steps (a) through (c) via the drain opening wherein the outer openings are positioned along a curved line that is radially spaced outwardly of the centrally located openings, said curved line traversing each of said smaller diameter tubular members wherein each said one or more centrally located openings is generally aligned with the bore of the larger diameter tubular member, and wherein each said outer opening may be generally aligned with the bore of a said smaller diameter tubular member.

2. The method of claim 1, wherein in step "a" there is a second fitting and each said fitting is attached to an end portion of the oil and gas well riser section.

3. The method of claim 2, wherein a suction is applied to each of the fittings to subject all said flow bores of the oil and gas well riser section to a vacuum during steps "a" through "d", wherein the vacuum at least in part holds the fittings to the oil and gas well riser section.

4. The method of claim 1, wherein some of the outer openings are aligned with a smaller diameter tubular member bore and some of the outer openings are not aligned with a smaller diameter tubular member bore.

5. The method of claim 1, wherein said first cleaning tool cleans the inside surface of the larger diameter tubular member while simultaneously or substantially simultaneously said second cleaning tool cleans the inside surface of the smaller diameter tubular member.

6. The method of claim 1, further comprising a third and a fourth cleaning tool for cleaning other outer smaller diameter tubular members, and wherein said first cleaning tool cleans the inside surface of the larger diameter tubular member while simultaneously or substantially simultaneously said second, third, and fourth cleaning tools clean the inside surfaces of the smaller diameter tubular members.

7. The method of claim 6, further comprising as many separate cleaning tools as there are tubular members, and wherein all cleaning tools simultaneously or substantially simultaneously clean the inside surfaces of the tubular members.

8. The method of claim 1 wherein said first cleaning tool and said second cleaning tool each have at least three leg extensions, the leg extensions each having a proximal portion attached to the tool that extends radially from the tool, and a distal portion that is parallel to the inner wall of the tubular member.

9. The method of claim 8 wherein the distal portion of the leg extensions also have one or more wheels on each leg, the wheels adapted to roll along the inner wall of the tubular member.

10. The method of claim 1 wherein the first and second cleaning tools are housed in a spool basket that has a lower portion and an upper portion, the lower portion comprising housings for high pressure air and water lines, and the upper portion adapted for housing two or more spool feeders, and two or more spools, having one spool and one spool feeder for each cleaning tool and wherein the spool basket is further connected to a control panel, the control panel adapted to control all of the cleaning tools simultaneously.

11. A method of cleaning an oil and gas well riser section while on location at an offshore well, the riser section having a central larger diameter tubular member having a flow bore and a plurality of smaller diameter tubular members connected to the central larger diameter tubular member, each smaller diameter tubular member having a flow bore, the method comprising the steps of;

a) placing a fitting on an end portion of the riser section, the fitting covering an end of the larger diameter tubular member and the ends of the smaller diameter tubular members, wherein the fitting has multiple openings including one or more centrally located openings and a plurality of circumferentially spaced apart outer openings that are spaced radially away from each of the one or more centrally located openings, said fitting having a drain opening;

b) inserting a first cleaning tool through the centrally located opening and into the larger diameter tubular member, wherein said first cleaning tool cleans the inside surface of the larger diameter tubular member;

c) inserting a second cleaning tool through one or more of the outer openings and into one or more of the smaller diameter tubular members, wherein said second cleaning tool cleans the inside surface of the smaller diameter tubular member or members; and d) removing fluid from the cleaning operations of steps (a) through (c) via the drain opening, wherein the outer openings are positioned along a curved line that is radially spaced outwardly of the centrally located openings, said curved line traversing each of said smaller diameter tubular members.

12. The method of claim 11, further comprising a step after step (a) of: placing a fitting on an opposite end portion of the riser section, the fitting covering an opposite end of the larger diameter tubular member and flange, and the ends of the smaller diameter tubular members, wherein the fitting has multiple openings including one or more centrally located openings and a plurality of circumferentially spaced apart outer openings that are spaced radially away from each of the one or more centrally located openings, said fitting having a drain opening.

13. The method of claim 11 wherein the first and second cleaning tools are connected to high pressure water lines on spool feeders and wherein the spool feeders are controlled simultaneously by a nearby control panel.

14. The method of claim 12 wherein the first and second cleaning tools comprise a nozzle, the nozzle having a tail that is at least the length of the nozzle, and at least three extensions connected to the tail, the extensions adapted to contact the inner bore of the tubular member to be cleaned.

15. The method of claim 14 wherein there is at least one wheel on each extension, the wheels adapted to roll along the inner bore of the tubular member to be cleaned.

16. The method of claim 13 wherein the spool feeders are housed in a compact spool basket adapted to be placed on the offshore well.

17. A method of cleaning a flanged pipe having a pipe section, an annular pipe flange attached to the pipe section and an open ended bore that is to be cleaned, comprising the steps of:

a) attaching to the pipe flange a support that attaches to the pipe flange at first and second spaced apart positions, the support having an upper rail and a lower rail;

b) placing a roller frame on the support, the roller frame including multiple rollers surrounding a hose opening;

c) wherein the roller frame of step "b" has upper and lower guides and one or more rollers;

d) enabling the roller frame to travel laterally upon the rails by engaging the upper rail with the upper guide and the lower rail with the lower guide;

e) placing a cleaning tool in the bore and a hose that extends through the hose opening and to the cleaning tool and cleaning the bore with the cleaning tool;

f) preventing travel of the cleaning tool through the hose opening during cleaning of step "e" in a direction that would remove a section of the hose from the bore;

g) wherein in step "f" the hose has an enlarged portion next to the cleaning tool that will not pass through the hose opening.

18. The method of claim 17 wherein the enlarged portion is a removable fitting or a removable annular member and further comprising attaching the removable fitting or the removable annular member to the hose next to the cleaning tool.

19. The method of claim 17 wherein in step "e" the cleaning tool is a fluid powered cleaning tool and the hose supplies pressured fluid to the cleaning tool.

20. The method of claim 17 wherein in step "g" the enlarged portion has a generally conically shaped outer surface portion and further comprising the step of positioning the generally conically shaped outer surface portion to engage the rollers when the hose attempts to back out of the bore during cleaning.

* * * * *